US007293932B2

(12) United States Patent
Wong

(10) Patent No.: US 7,293,932 B2
(45) Date of Patent: Nov. 13, 2007

(54) LEVER ARCH BINDER MECHANISM WITH COMPLEMENTARY RING TIPS

(75) Inventor: Yiu Wing Wong, Ma On Shan (HK)

(73) Assignee: Hong Kong Stationery Manufacturing Co., Ltd., Kowloon (HK)

( * ) Notice: Subject to any disclaimer, the term of this patent is extended or adjusted under 35 U.S.C. 154(b) by 489 days.

(21) Appl. No.: 10/901,300

(22) Filed: Jul. 29, 2004

(65) Prior Publication Data

US 2005/0260029 A1 Nov. 24, 2005

Related U.S. Application Data

(63) Continuation-in-part of application No. 10/849,546, filed on May 20, 2004.

(51) Int. Cl.
*B42F 3/04* (2006.01)

(52) U.S. Cl. ..... 402/35; 402/34

(58) Field of Classification Search ..... 402/36, 402/39, 41, 20, 63, 8, 19, 26, 31, 35, 37, 402/38, 70, 73, 34
See application file for complete search history.

(56) References Cited

U.S. PATENT DOCUMENTS

| | | | | |
|---|---|---|---|---|
| 509,972 | A | 12/1893 | Brewer | |
| 534,260 | A | 2/1895 | Gottwals | |
| 538,605 | A | 4/1895 | Stoelting | |
| 550,164 | A | 11/1895 | Durey | |
| 724,829 | A | 4/1903 | Eberth | |
| 778,910 | A | 1/1905 | Soennecken | |
| 778,992 | A | 1/1905 | Nelson | |
| 790,382 | A | 5/1905 | McBride | |
| 849,430 | A | 4/1907 | Shallcross | |
| 1,618,842 | A | 2/1927 | Von Der Marwitz | |
| 2,460,718 | A | 2/1949 | Stevens | |
| 2,494,898 | A * | 1/1950 | Rea | 402/35 |
| 2,744,530 | A * | 5/1956 | Swenson | 402/20 |
| 2,789,561 | A | 4/1957 | Bonn et al. | |
| 2,894,513 | A | 7/1959 | Gempe et al. | |
| 3,057,357 | A | 10/1962 | Duncan | |
| 3,728,036 | A | 4/1973 | Cott | |
| 4,415,290 | A | 11/1983 | Ohminato | |
| 4,607,970 | A * | 8/1986 | Heusinkveld | 402/20 |
| 4,678,357 | A | 7/1987 | Kissel et al. | |
| 4,690,580 | A | 9/1987 | Kissel | |
| 4,815,882 | A | 3/1989 | Ohminato | |
| 4,904,103 | A * | 2/1990 | Im | 402/35 |
| 4,948,286 | A | 8/1990 | Hofmann | |
| 5,269,616 | A | 12/1993 | O'Neill | |
| 5,332,327 | A | 7/1994 | Gillum | |

(Continued)

FOREIGN PATENT DOCUMENTS

EP 962336 A1 * 12/1999

*Primary Examiner*—Erica Cadugan
(74) *Attorney, Agent, or Firm*—Shoemaker and Mattare

(57) ABSTRACT

A ring binder mechanism has D-shaped rings formed by a straight, stationary part, and a movable mating part having an arcuate shape. A recess is formed in the tip of the movable part, and a protrusion at the tip of the stationary part seats in the recess. A lateral window in the recessed tip, intersecting the recess, enables the protrusion to seat smoothly in the recessed tip notwithstanding the fact that the relative motion between the approaching tips has a large lateral component.

6 Claims, 2 Drawing Sheets

U.S. PATENT DOCUMENTS

| | | | | | |
|---|---|---|---|---|---|
| 5,393,156 | A | | 2/1995 | Mullin et al. | |
| 5,692,847 | A | * | 12/1997 | Zane et al. | 402/38 |
| 5,765,956 | A | | 6/1998 | Lanzarin | |
| 5,782,569 | A | | 7/1998 | Mullin et al. | |
| D430,204 | S | * | 8/2000 | Berracasa | D19/32 |
| 6,142,697 | A | | 11/2000 | Williams | |
| 6,270,280 | B1 | * | 8/2001 | Baumann | 402/39 |
| 6,328,497 | B1 | | 12/2001 | To | |
| 6,637,968 | B2 | * | 10/2003 | Ko | 402/41 |
| 6,761,497 | B2 | | 7/2004 | Kaneda | |
| 2003/0044221 | A1 | | 3/2003 | To et al. | |
| 2004/0013463 | A1 | | 1/2004 | To | |

* cited by examiner

LEVER ARCH BINDER MECHANISM WITH COMPLEMENTARY RING TIPS

This application is a continuation-in-part of application Ser. No. 10/849,546 filed May 20, 2004.

BACKGROUND OF THE INVENTION

This invention relates to a ring binder mechanism having an actuating crank.

Many modern ring binder mechanisms have actuating levers for opening and closing two, three or more rings. In some such devices, the levers also lock the rings closed. The typical arrangement is to attach the bottoms of the ring halves to hinged plates confined between the edges of an arcuate metal housing which provides a toggling action as the plates snap between open and closed positions.

Other devices have been proposed in which the rings are opened and/or closed by a cam-type mechanism. Prior such constructions are seen in U.S. Pat. Nos. 778,910, 2,494,898, 2,789,561, and 2,894,513. U.S. Pat. No. 778,910 discloses a two-ring binder mechanism which is opened by lifting the end of a lever which depresses a crank whose ends are the movable ends of the two rings. U.S. Pat. No. 6,637,968 shows a device more closely related to the present invention.

In most ring binder mechanisms, the opposed ring parts are both semicircular, so that when they are closed, they form substantially a circular shape. One problem with semicircular ring parts is that they do not make it easy to load or remove large numbers of papers at once onto or off of the rings. Automatic machine loading of papers onto such rings is particularly difficult. For this reason, some prior inventors have developed rings in which one segment is straight, or almost so. With such rings, commonly called D-rings, a large group of papers can be lowered right onto the straight segments very simply and quickly. But since D-rings are not symmetrical, the tips meet to the left or right of the center plane of the mechanism and therefore approach one another not axially, but rather with a lateral component so that the line of approach is oblique to the length of the straight segment. The greater the offset, the greater the lateral component.

An oblique approach direction creates difficulty when one tip has a protrusion designed to seat within in recess in the other. With this construction, an oblique approach may result in interference between the approaching tips, preventing or impeding proper seating. The solution to this problem, until now, has been to bend the tip of the straight segment inward so that it points at the approaching tip of the arcuate segment. Bending the tip, however, works against the goal of facilitating the installation and removal of large groups of papers.

SUMMARY OF THE INVENTION

An object of the invention is to improve the operation of a crank-operated ring binder mechanism having two or more rings.

An object of the invention is to provide a ring binder mechanism having D-shaped rings of either the slanted type on non-slanted type, having a perfectly straight segment onto which large groups of papers can be easily loaded and removed.

A related object is to provide a ring tip geometry which permits the tips to approach one another at a substantial angle to their length, and to seat smoothly and without interference.

These and other objects are attained by a ring binder mechanism having a support plate, and at least two rings, each comprising a movable segment pivotally attached to the support plate and an immovable segment affixed to said support plate, and a crank for moving the rings between an open position and a closed and locked position. The crank, which is pivotally supported on the support plate for oscillation about a longitudinal axis, has one or more throws offset from the longitudinal axis. The movable ring segments are integrally attached to the crank. A leaf spring biases the crank toward a rings-closed position, and a manually operable lever moves the crank toward a rings-open position. The lever is pivotally mounted on said support plate and depresses the throw, driving the crank towards its rings-closed position, as the lever is depressed.

BRIEF DESCRIPTION OF THE DRAWINGS

In the accompanying drawings.

DESCRIPTION OF THE PREFERRED EMBODIMENT

Figure 1:
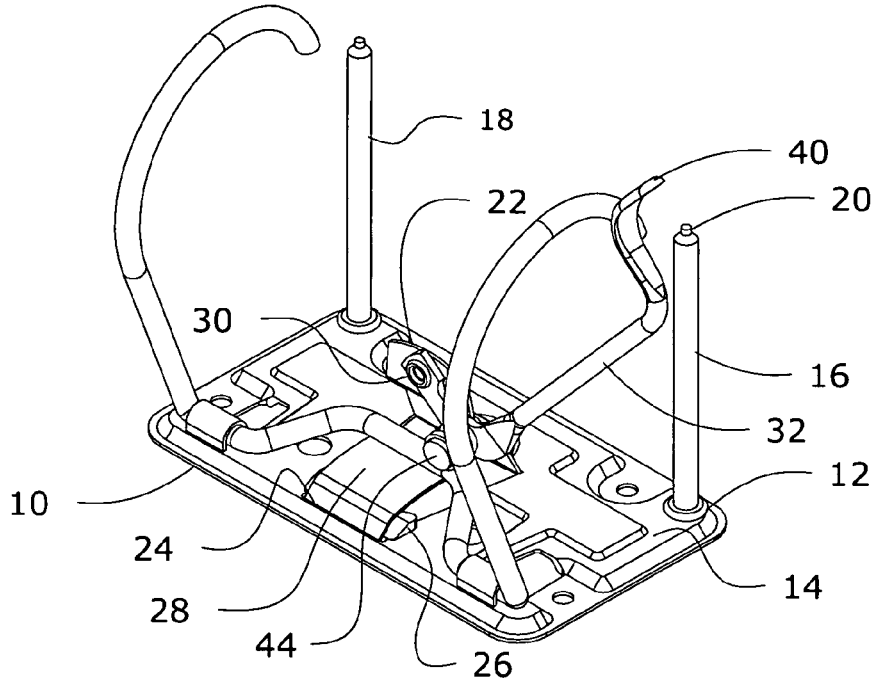
FIG. 1 is an isometric view of a two-ring binder mechanism embodying the invention, showing the binder mechanism in its open configuration.

The invention is embodied in a mechanism comprising a support plate 10 having raised portions or plateaus, which reinforce the plate, formed by embossing. Projections 12 on the plateau 14 support the bottoms of straight, stationary ring members 16, 18 which extend perpendicular to the support plate. The upper ends of the stationary members terminate at tips 20.

A large tab 22 is bent perpendicularly out from the support plate. A narrow slot 24 is cut across the top of the space from which the tab was deformed, leaving a bridge 26 which is deformed slightly upward and bears against the bottom surface of a leaf spring 28 whose fixed end is held within the slot. The leaf spring's free end provides an upward bias against a crank described below.

A pin 30 is staked or welded to the top of the tab, facing the spring side.

One end of an actuating lever 32 is pivotally mounted on the pin, whose head is flattened to retain the lever.

The lever has a first end segment 34, an intermediate segment 36 perpendicular to the first end, and a second end segment 38 perpendicular the intermediate segment. A flattened tip 40 extends from the end of the second end, parallel to the intermediate segment. The lever 32 pivots in the center plane of the device. It has a circumferentially grooved nylon roller 42 fixed on a headed pin 44 which is fixed to and extends from the lever near the intersection of the first end segment and the intermediate segment. The distance between the pins 30 and 44 is about half an inch.

Two movable ring segments 46, 48 extend from opposite ends of a common crank 50. Each movable ring segment is J-shaped, having a straight segment 52 connected to the crank and a curved segment 54. The end 55 (FIG. 3) of the curved segment has a conical recess 57 which receives the complementarily shaped tip 20 of the fixed segment.

Figure 2:
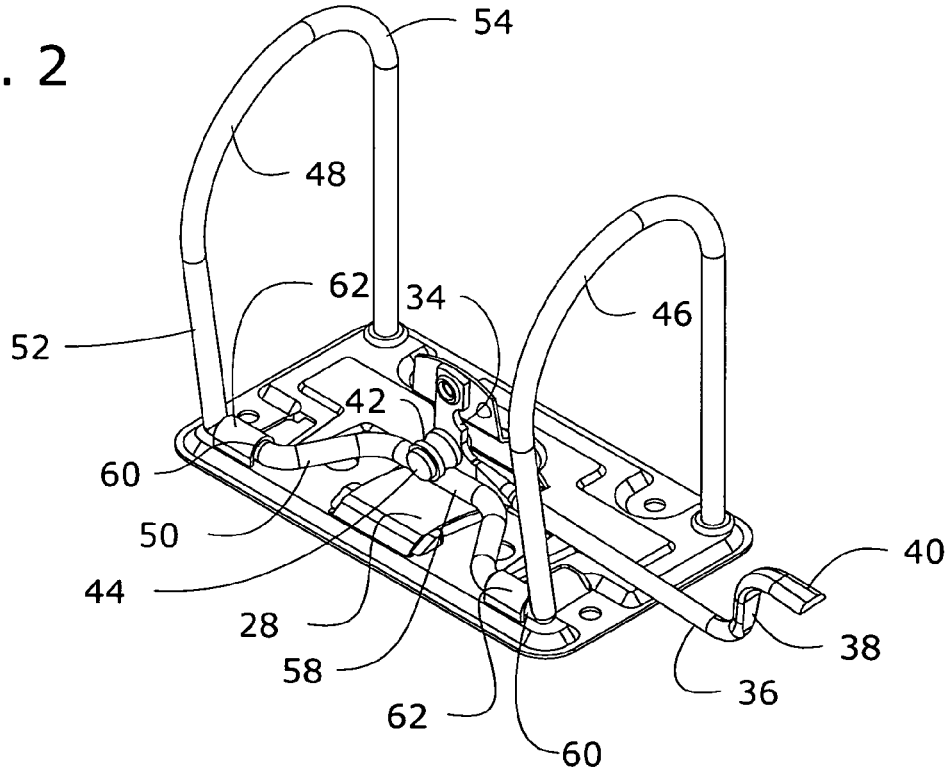
FIG. 2 is a similar view of an alternative form of the invention, showing the binder mechanism in its closed configuration.

The crank 50 (FIG. 2) has a throw formed by a straight segment 58 offset from the crank journals 60. The crank is pivotally retained against the support plate by tabs 62 which are bent up out of the support plate and are curled around the journals 60 to form plain bearings. The leaf spring 28 bears up against the bottom of the throw 58, tending to move the crank in a direction which opens the ring segments.

The nylon roller 42 engages the crank throw 58 from above. As the lever is depressed, the roller rolls along the crank throw, pushing the throw towards the support plate, thus closing the ring segments. When the lever strikes the support plate (FIG. 2), the roller is slightly past the center of the throw, and locks the throw down. The upward bias provided by the spring 28 holds the lever in this position until the lever is manually released.

Figure 3:
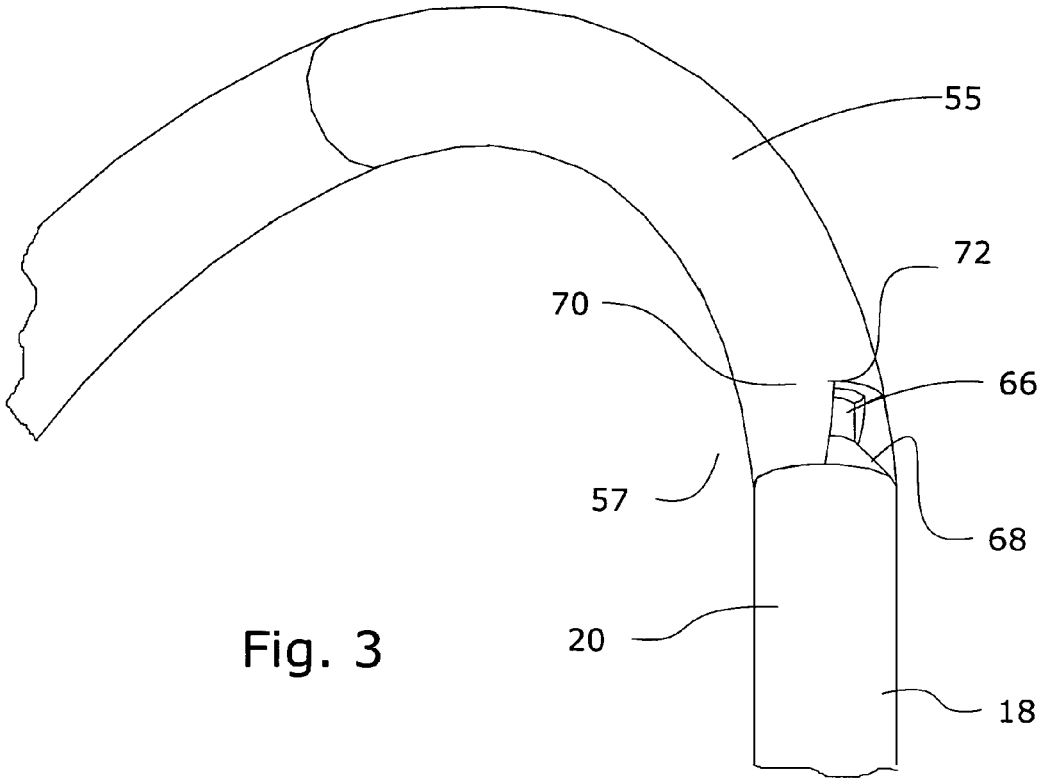
FIG. 3 shows the ring tips, slightly ajar.

FIG. 3 shows the ring tips, greatly enlarged. The tip 20 of the stationary part 18 has a protrusion 66 of a diameter substantially less than that of the ring cross-section. The protrusion is shown with a conical base part 68, but these details are only preferred. Whatever the exact shape of the protrusion, the tip 55 of the curved part of each movable ring segment 46, 48 has a complementary recess 70 for receiving the protrusion 66. A window 72 is provided to permit the protrusion 66 to enter into the recess at an angle, since the tips do not approach one another lengthwise, but rather at a substantial angle to the length of the stationary part. The window may have various shapes, but in any event it should be at least as large as the cross-section of the protrusion 66, so that the protrusion can enter the recess without interference. The window may be made somewhat larger than that, to account for tolerances and bending of the components; however, too large a window would result in a less secure union between the mating tips.

Figure 4:
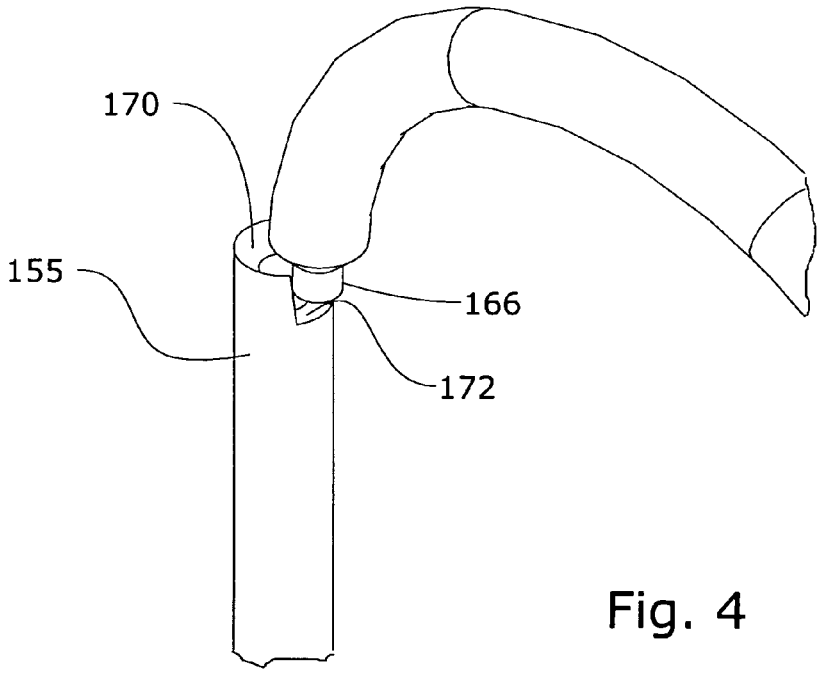
FIG. 4 is a view like FIG. 3, showing an alternative form of the invention.

While the protrusion has been described and shown on the stationary segment, with the complementary recess on the movable segment, it is possible to reverse the arrangement. FIG. 4 shows this modification: here, the stationary straight part of the ring has a recess 170 in its tip 155, and the movable curved part has a protrusion 166 adapted to seat in the recess. Note that the window 172 intersects the recess on only one side of the tip, i.e. on the inside of the ring, facing the center plane of the binder, but the idea is the same—to permit the protrusion to land smoothly in the recessed tip without interference.

Although the device illustrated is a two-ring binder, it should be understood that the invention is equally applicable to binders having more than two rings.

Since the invention is subject to modifications and variations, it is intended that the foregoing description and the accompanying drawings shall be interpreted as only illustrative of the invention defined by the following claims.

I claim:

1. In a ring binder mechanism comprising a base plate supporting a plurality of rings, each ring comprising a stationary part and a movable part, and a crank for moving the movable part of each ring so that the rings can be opened and closed, the improvement wherein one of the parts substantially arcuate, terminating at a first tip, and the other of said parts is straight, terminating at a second tip, so that the tips approach one another in a direction substantially oblique to the length of the straight part as the rings are closed, one of said tips has a protrusion and the other of said tips has a complementary recess for receiving the protrusion when the rings are closed, and the tip with the complementary recess also has a lateral window intersecting the recess from only one side, the window being situated and shaped to permit the protrusion to enter the recess in said direction substantially oblique to the length of the straight part but to prevent it from moving in other directions with respect to the recess once seated in the recess.

2. The invention of claim 1, wherein the arcuate part is the movable part and the straight part is the stationary part.

3. The invention of claim 1, wherein the crank interconnects all the movable ring parts, and further comprising means for driving the crank toward a rings-open position, and a spring for biasing the crank toward a rings-closed position.

4. The invention of claim 3 wherein the driving means is a lever pivotally supported on the base plate, the lever having an element for engaging the crank.

5. The invention of claim 4, wherein the element for engaging the crank is a roller mounted on the lever.

6. The invention of claim 1, wherein said recess is substantially conical.

* * * * *